United States Patent [19]

Houtkamp

[11] 4,153,316

[45] May 8, 1979

[54] METHOD OF SEALING AN IMAGE INTENSIFIER TUBE, AND AN IMAGE INTENSIFIER TUBE THUS PRODUCED

[75] Inventor: Johannes J. Houtkamp, Delft, Netherlands

[73] Assignee: N.V. Optische Industrie "De Oude Delft", Netherlands

[21] Appl. No.: 787,933

[22] Filed: Apr. 15, 1977

[30] Foreign Application Priority Data

Apr. 20, 1976 [NL] Netherlands ..... 7604144

[51] Int. Cl.[2] ..... H01J 9/18

[52] U.S. Cl. ..... 316/19; 29/25.16

[58] Field of Search ..... 29/25.16, 25.13, 25.17; 316/19

[56] References Cited

U.S. PATENT DOCUMENTS 3,337,933 8/1967 Seiffarth et al. ..... 29/25.16

*Primary Examiner*—Richard B. Lazarus

*Attorney, Agent, or Firm*—O'Brien and Marks

[57] ABSTRACT

An image intensifier tube is made by building an anode window subassembly and a cathode window subassembly each ending in a ring having a projecting peripheral edge. The two subassemblies are placed in a vacuum chamber and the two rings are peripherally interconnected by cold welding.

4 Claims, 3 Drawing Figures

Figure 1:
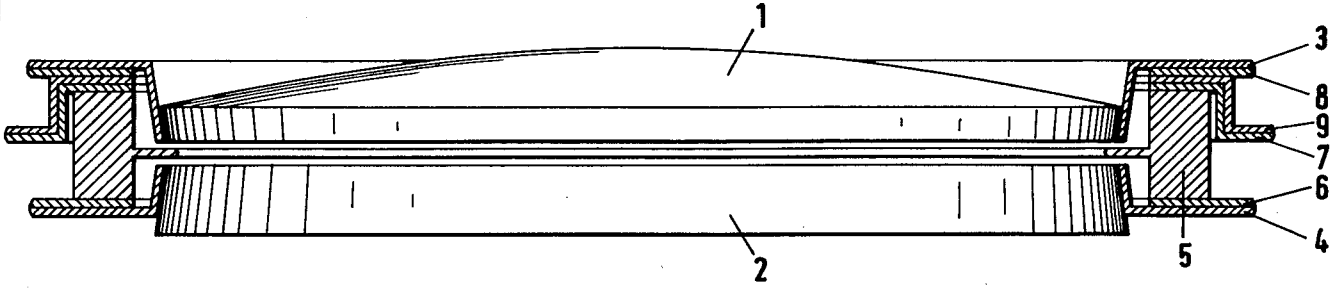

METHOD OF SEALING AN IMAGE INTENSIFIER TUBE, AND AN IMAGE INTENSIFIER TUBE THUS PRODUCED

This invention relates in general to a method of sealing an image intensifier tube and to an image intensifier tube manufactured by this method.

In the manufacture of image intensifier tubes in which there is a relatively large distance between the anode window and the cathode window it is common practice to interconnect the two windows through flanges by means of an electrically insulating side wall, which wall has an opening through which the inner surfaces of the windows can be processed and the space between these windows can be evacuated, after which steps this opening is sealed.

Problems arise, however, if the distance between the two windows is very small or if the above method cannot be performed on account of other reasons. For example, this small distance may render it difficult or even impossible to provide the photocathode in a correct manner on the appropriate window through the opening. Such problems occur, for example, in an image intensifier tube of the so-called proximity-focus type.

It has been tried to solve such problems by providing each window with connecting means, subsequently performing the required processing of the windows and finally securing the connecting means to each other in a vacuum-tight fashion. To this end, for example, an indium ring interposed between the connecting means has been used.

It turned out in actual practice, however, that the vacuum-tightness of such an indium ring leaves much to be desired in many instances, while furthermore this method usually requires V-shaped grooves to be made in the connecting means for receiving the ring, which results in an increase in the manufacturing cost. Moreover, as indium is fundamentally rather a soft material, the manageability of the resultant tube will be bound by certain limitations.

A further drawback of such an indium ring is that in the event of a non-circular cross-section of the tube, for example a square or a rectangular one, sealing problems will occur at the corners of the cross-section. Moreover, the provision of the photocathode will often require shielding the indium ring in order to prevent the cathode surface from being contaminated by the indium.

It is an object of the present invention to at any rate partly, and if possible fully, eliminate the above drawbacks.

To this end the present invention provides a method of sealing an image intensifier tube, in which both the cathode window and the anode window are provided with a substantially radial, electrically conductive flange secured thereto, a substantially axial wall being interposed between the flanges, said wall being electrically insulated relative to at least one of said flanges, which method is characterized in that a first, substantially radial ring is connected to the flange secured to one window, that a second, substantially radial ring is connected to the end of the wall remote from the other window, and that, after placing the interior of the tube into working order, these first and second rings are secured to each other along their free edges by cold welding.

In the event the wall is substantially radially divided into wall sections, in accordance with the present invention a first, substantially radial ring is connected to the distal end of the wall section associated with one window, a second, substantially radial ring is connected to the distal end of the wall section associated with the other window, and, after placing the interior of the tube into working order, these first and second rings are secured to each other at their free ends by cold welding.

Figure 2:
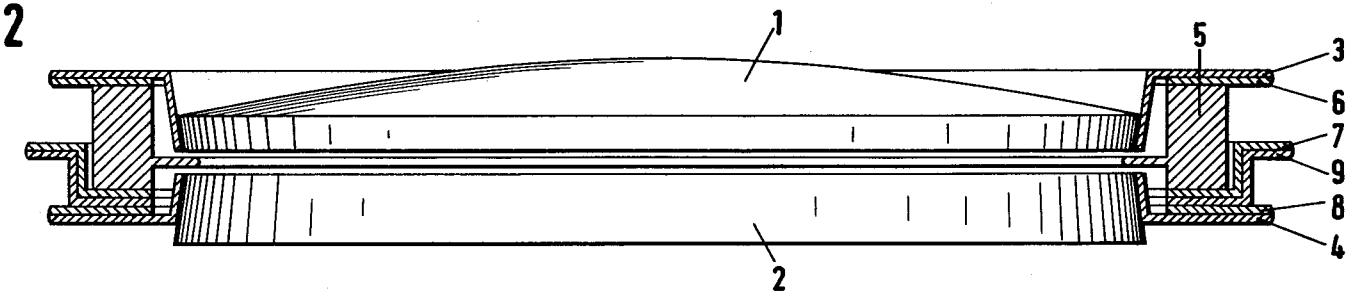
Figure 3:
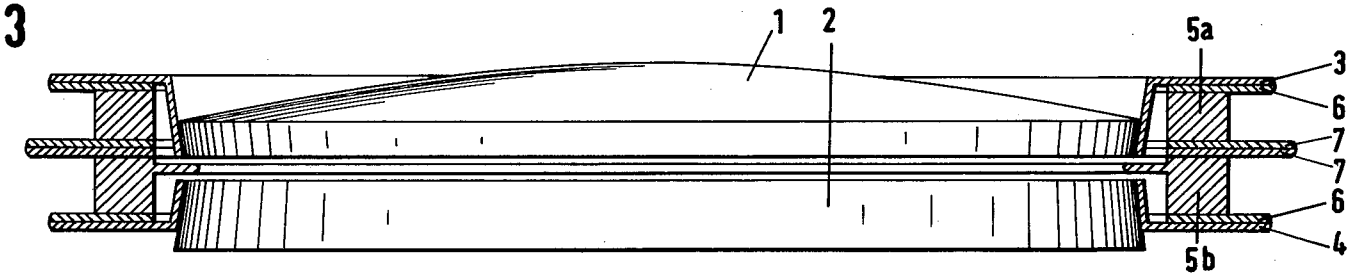

The invention will now be described with reference to the accompanying drawings in which FIGS. 1, 2 and 3 show three embodiments of an image intensifier tube of the proximity-focus type in cross sectional elevation, to which tube the present invention is applicable.

FIG. 1 shows an image intensifier tube comprising two windows 1 and 2, constituting the cathode window and the anode window, respectively. These windows are usually of fibre-optic glass sheet. In the manufacture of the image intensifier tube in question, two flanges 3 and 4 of suitable material, e.g. a Cr-Ni-Fe alloy, such as Vacovit (a registered trademark), are secured by means of, for example, a frit to windows 1 and 2, respectively. After securing these flanges to the windows, the two glass sheets can be subjected to the appropriate processing; for example, a phosphor layer may be deposited on the anode window.

In a second phase of the method according to the invention use is made of a wall or ring 5 of, for example, $Al_2O_3$ ceramic, one end of which is secured by means of, for example, hard solder to a disk-shaped ring 6 of suitable material, e.g. an Fe-Ni-Co alloy, such as Vacon 70 (a registered trademark), and the other end of which is secured by means of, for instance, hard solder to a copper ring 7.

In a subsequent phase of the manufacture a disk-shaped ring 8 of suitable material, e.g. an Fe-Ni-Co alloy, such as Vacon 70, is secured in an appropriate manner, for example, by soldering, to a copper ring 9.

At this stage of the manufacture of the image intensifier tube, consequently, there are four separate components.

After a further processing of the windows, such as polishing and the like, the ring 6 is secured to the flange 4 and the ring 8 is secured to the flange 3 by for example argon-arc welding.

Now two separate components remain, which are to be secured to each other in accordance with the present invention so as to provide the image intensifier tube.

To this end, the two components are placed in a so-called processing chamber in which a process is performed that is customary in the manufacture of such a tube. A high vacuum is maintained in this processing chamber and the components are heated to a temperature of, for example, about 400° C., after which cooling takes place and a photo-sensitive layer is deposited on the cathode window. A number of further depositions is performed, after which again cooling takes place.

Subsequently the processing chamber can be sealed, for example by pinching off the connection with the vacum pump, and the two components of the image intensifier tube are moved towards each other in vacuum until the desired distance between the windows is obtained, at which time the edges of the copper rings 7 and 9 abut each other. Subsequently, the peripheral edges of the two copper rings 7 and 9, radially projecting from ring 5, are engaged by a tool having the form of a pair of tongs, which tool exerts a pressure of for example 10–25 tonnes on these edges. Thus the free edges of rings 7 and 9 are secured to each other by cold welding.

As a final step of the procedure, the finished image intensifier tube is removed from the chamber.

While in the embodiment just described with reference to FIG. 1, the cold-weld connection is effected on the cathode end of the tube, a similar procedure can be used to produce said connection at the anode end. That embodiment is illustrated in FIG. 2.

Here again, the magnifier tube is shown to have two windows 1, 2, respectively constituting the cathode window and the anode window, normally consisting of a fibre-optic glass sheet. In manufacturing the intensifier tube, two flanges 3, 4 of a suitable material, for example, Vacovit, are respectively connected to windows 1, 2, by means, for example, of a glass frit. Thereafter the two glass sheets may be processed, for example, a phosphor layer may be applied to the anode window.

In a second phase of the method according to the present invention, a wall or ring 5, consisting for example of $Al_2O_3$ ceramic, is connected on one end to a ring 6 of a suitable material, such as Vacon 70, for example by means of hard solder, and connected on the other end to a copper ring 7, for example, also by means of hard solder.

In a subsequent phase of the manufacture a ring 8 of a suitable material, e.g. Vacon 70, and a copper ring 9 are connected together in a suitable manner, e.g. by soldering. After a possible further treatment of the windows, e.g. polishing and the like, ring 8 is connected to flange 4 and ring 6 to flange 3, for example, by argon arc-welding.

The two sub-assemblies thus produced are introduced into a processing chamber for processing in a conventional manner as described with reference to FIG. 1. After sealing the processing chamber, the two subassemblies of the image intensifier tube are moved towards one another in vacuo until the required spacing between the two windows is obtained at which time the edges of the two copper rings 7 and 9 abut each other. Subsequently the free peripheral edges of the two copper rings, which radially project from ring 5, are engaged by a tool in the form of a pair of tongs, which excercises a pressure of, e.g. 10–25 tonnes on these edges, whereby said edges of rings 7 and 9 are interconnected by cold welding.

The completed image intensifier tube is then removed from the processing chamber.

FIG. 3 shows an embodiment of an image intensifier tube of the proximity-focus type, in which ceramic ring 5 is divided into two sections 5*a* and 5*b*.

In this embodiment, the tube has two windows 1 and 2, respectively constituting a cathode window and an anode window, normally consisting of a fibre-optic glass sheet.

In making the image intensifier tube, two flanges 3, 4 are respectively connected to windows 1, 2, for example by means of a frit. Thereafter the two glass sheets may be processed.

In a second phase of the method according to the present invention, sections 5*a* and 5*b*, consisting e.g. of $Al_2O_3$ ceramic, are each connected at one end to a ring 6 of a suitable material, e.g. Vacon 70, by means for example of hard solder, and on their other end to a copper ring 7, also by means of hard solder.

After further processing the windows, e.g. polishing, ring 6 is connected to flange 4 and ring 8 to flange 3, e.g. by argon arc-welding. The resulting subassemblies of the image intensifier tube are introduced into a processing chamber for processing in a conventional manner as described with reference to FIG. 1.

After sealing the processing chamber the two subassemblies are moved towards one another in vacuo until the two windows 1, 2 are at the required distance from each other. Subsequently a tool in the form of a pair of tongs is positioned to engage the free peripheral edges of the two copper rings 7, which tool exerts a pressure of 10–25 tonnes on these edges, whereby they are interconnected by cold welding.

The finished image intensifier tube is then removed from the processing chamber.

It has turned out that in the above manner an image intensifier tube having a high quality sealing can be achieved, even in the event of a non-circular cross-section of such a tube.

It is observed that the above materials such as Vacovit and Vacon 70 and the $Al_2O_3$ ceramic are mentioned by way of example only and that the present invention is not limited to the use of these materials.

Finally it is observed that the cold-welded seal according to the invention may also be applied to image intensifier tubes that are not of the proximity-focus type but in which there is a relatively large distance between the windows. However, the advantages of the method according to the invention are most striking in a tube of the proximity-focus type.

Although, in the embodiments described, the intermediate wall or ring is made of an electrically insulating material, it will be clear to those skilled in the art that it may as well be made of an electrically conducting material, provided it is electrically insulated relative to at least one of the flanges of the windows.

I claim:

1. A method of making an image intensifier tube having cathode and anode windows on a common optical axis comprising the steps of securing a substantially radial, electrically conductive flange to the periphery of each of said cathode and anode windows, depositing a phosphor layer on said anode window, connecting a first ring to a first one of said conductive flanges with an edge of said first ring projecting radially beyond said conductive flanges, connecting a second ring to one side of a ring-shaped wall of electrically insulating material, securing the other side of said wall to the other of said conductive flanges, placing the anode and cathode windows with the secured flanges and wall and with the connected rings in a vacuum, depositing a photo-sensitive layer on the cathode window in said vacuum, moving said anode and cathode windows to positions along a common optical axis in spaced relationship to each other with the edge of said first ring abutting an edge of said second ring in said vacuum after said depositing of the photo-sensitive layer, and cold welding said abutting edges together in said vacuum whereby the first and second rings are sealing secured to each other.

2. A method according to claim 1 wherein said connecting of the first ring to the one flange comprises soldering a first disc to said first ring and then securing said first disc to said one flange, said connecting of the second ring to the one side of the wall comprises soldering said second ring to a first end face of said wall, and said securing of the other side of the wall to the other flange comprises soldering a second disc to a second end face of said wall and securing said second disc to said other flange before the cold welding step is performed.

3. A method according to claim 2 wherein said first and second rings are made of copper, said first and second discs are made of an iron-nickel-cobalt alloy, said wall is made of $Al_2O_3$ ceramic, and argon arc-welding is utilized to secure said first and second discs to said first and second flanges, respectively.

4. A method of making an image intensifier tube having cathode and anode windows on a common optical axis comprising the steps of securing a substantially radial, electrically conductive flange to the periphery of each of said cathode and anode windows, depositing a phosphor layer on said anode window, connecting first and second rings to one sides of respective first and second ring-shaped wall sections of electrically insulating material, securing the other sides of the respective ring-shaped wall sections of electrically insulating material to said flanges, placing the anode and cathode windows with the secured flanges and wall sections and with the connected rings in a vacuum, depositing a photo-sensitive layer on the cathode window in said vacuum, moving said anode and said cathode windows to positions along a common optical axis in spaced relationship to each other with the edge of said first ring abutting an edge of said second ring in said vacuum after said depositing of the photo-sensitive layer, and cold welding said abutting edges together in said vacuum whereby the first and second rings are sealingly secured to each other.

* * * * *